US007617831B2

(12) United States Patent
Cacianti et al.

(10) Patent No.: US 7,617,831 B2
(45) Date of Patent: Nov. 17, 2009

(54) WASH BOOTH FOR CONTAINERS

(75) Inventors: Roberto Cacianti, Balbano (IT); Marco Panattoni, Porcari (IT)

(73) Assignee: Romaco S.R.L., Rastignano (Bologna) (IT)

( * ) Notice: Subject to any disclaimer, the term of this patent is extended or adjusted under 35 U.S.C. 154(b) by 623 days.

(21) Appl. No.: 11/068,879

(22) Filed: Mar. 2, 2005

(65) Prior Publication Data

US 2005/0199276 A1 Sep. 15, 2005

(30) Foreign Application Priority Data

Mar. 12, 2004 (IT) ..... BO2004A0149

(51) Int. Cl.
*B08B 3/00* (2006.01)

(52) U.S. Cl. ..... 134/105; 134/95.2; 134/166 R; 134/200

(58) Field of Classification Search ..... 134/95.2, 134/105, 166 R, 200
See application file for complete search history.

(56) References Cited

U.S. PATENT DOCUMENTS

| | | | | |
|---|---|---|---|---|
| 3,915,180 | A * | 10/1975 | Jacobs | 134/58 D |
| 5,456,167 | A | 10/1995 | George et al. | |
| 5,979,472 | A * | 11/1999 | Lowery et al. | 134/58 R |
| 7,086,408 | B2 * | 8/2006 | Stroppolo | 134/167 R |

FOREIGN PATENT DOCUMENTS

| | | |
|---|---|---|
| DE | 921 689 | 11/1954 |
| DE | 33 47 590 | 7/1985 |
| DE | 35 00 487 | 7/1986 |
| DE | 42 30 899 | 3/1993 |
| DE | 42 22 007 | 1/1994 |
| GB | 765911 | 1/1957 |
| JP | 01 245888 | 10/1989 |
| JP | 04 290587 | 10/1992 |

* cited by examiner

*Primary Examiner*—Michael Barr
*Assistant Examiner*—Jason Heckert
(74) *Attorney, Agent, or Firm*—The Nath Law Group; Jerald L. Meyer; Robert T. Burns

(57) ABSTRACT

A wash booth (1) for containers comprises a platform (3) for supporting a container (2), a wall (4) equipped with a water-tight door (5) and means for washing the inside walls of the container comprising infrared radiant elements (13).

1 Claim, 9 Drawing Sheets

FIG. 7
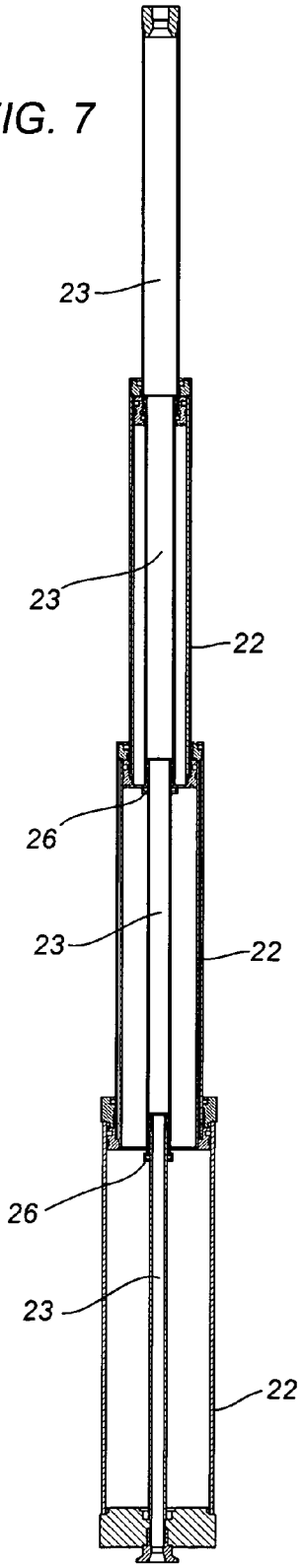
FIG. 7b
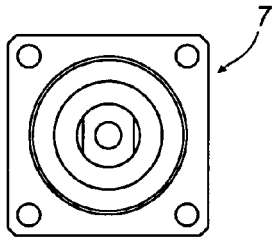
FIG. 7a
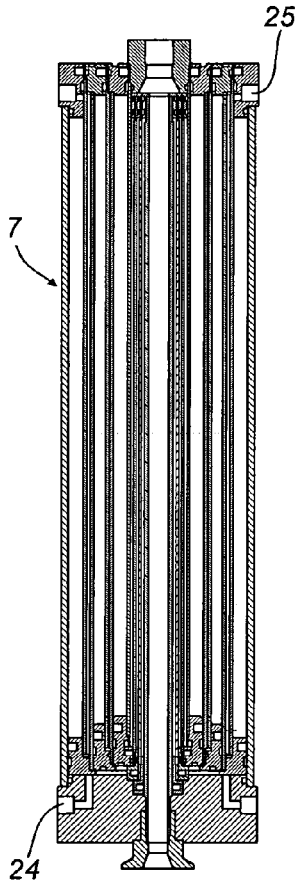
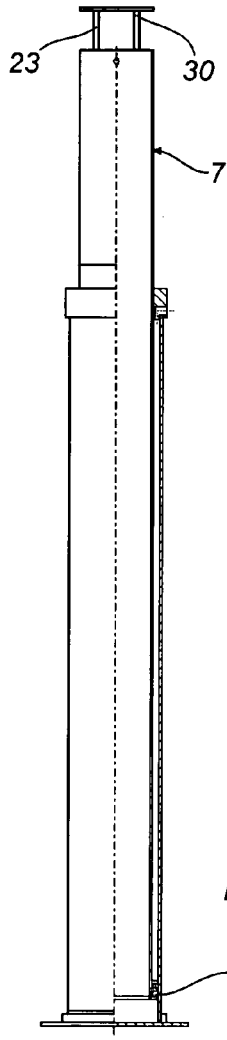
FIG. 7c

WASH BOOTH FOR CONTAINERS

BACKGROUND OF THE INVENTION

The present invention relates to the sector of washing and drying of containers used in the chemical/pharmaceutical and food industries and in any industry where high standards of hygiene and washing efficiency are required.

At present, the containers to be washed are normally placed inside special enclosures, usually known as wash booths, equipped with spray nozzles for treating the inside and outside of the containers, and with hot air nozzles for drying them.

These systems, however, offer relatively low drying efficiency and have a high energy requirement for effective drying.

Also, the hot air used to dry the container, although it removes the residual wash water, heats the container as well as the surrounding environment, resulting in a considerable waste of energy.

Further, prior art booths are relatively complex in the performance of the washing and drying steps, which means that the overall operating cycle is considerably slow.

Another disadvantage of prior art wash booths is the irregularity of the inside walls of the booth, especially where the door is, which makes it difficult to properly drain off all the used wash water which in turn makes it more difficult to clean the booth itself for subsequent use.

The trade therefore strongly feels the need for a container wash booth with improved efficiency that can perform a complete washing and drying cycle with minimum energy consumption.

The need is also felt for a wash booth that is quick and easy to dry so it is ready to be used again, even to wash containers of different products.

SUMMARY OF THE INVENTION

The aim of the present invention is, therefore, to overcome the disadvantages of prior art systems by providing a wash booth according to the main appended claim.

The advantages of the invention lie essentially in the drying speed that can be achieved by selective heating of the washing liquid used, thereby reducing the energy requirement and increasing the specific efficiency of the system.

Other advantages of the wash booth according to the invention are set out in the dependent claims and lie essentially in the constructional simplicity of the booth, the completeness of the washing and drying cycle, and the versatility of the booth which can easily be used for different applications such as the sterilization of the inside and/or outside of the container treated.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

FIGS. 7, 7*a* and 7*b* are detail views showing a telescopic cylinder of the unit of FIG. 4 in an extended condition, in a retracted condition and in a top view, respectively;

FIG. 7*c* shows a construction detail of the cylinder of FIG. 7 for introducing hot air into the container;

DESCRIPTION OF THE PREFERRED EMBODIMENTS

Figure 1:
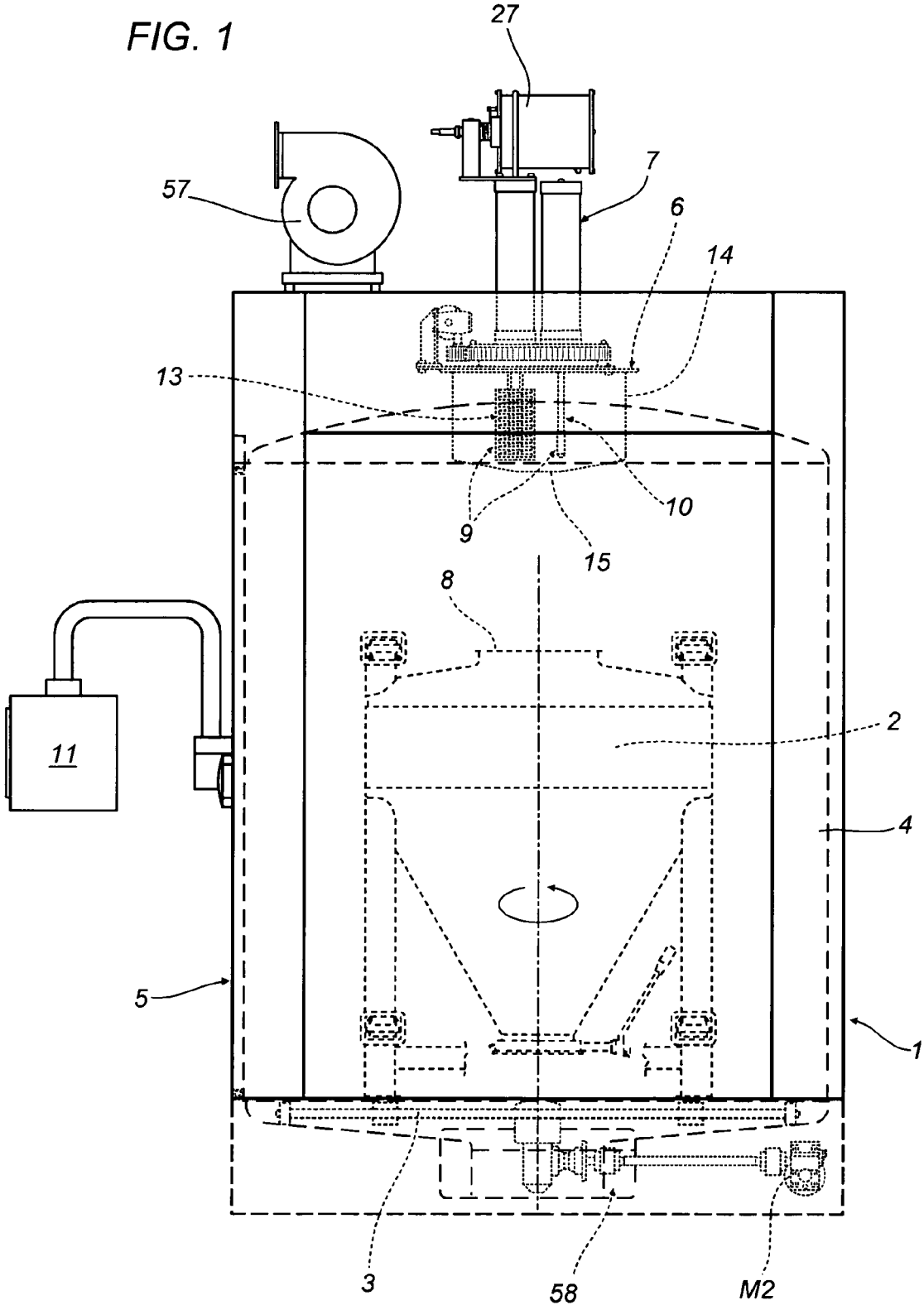
FIG. 1 shows a side view of a wash booth according to the invention and, inside it, a container to be treated.
Figure 2:
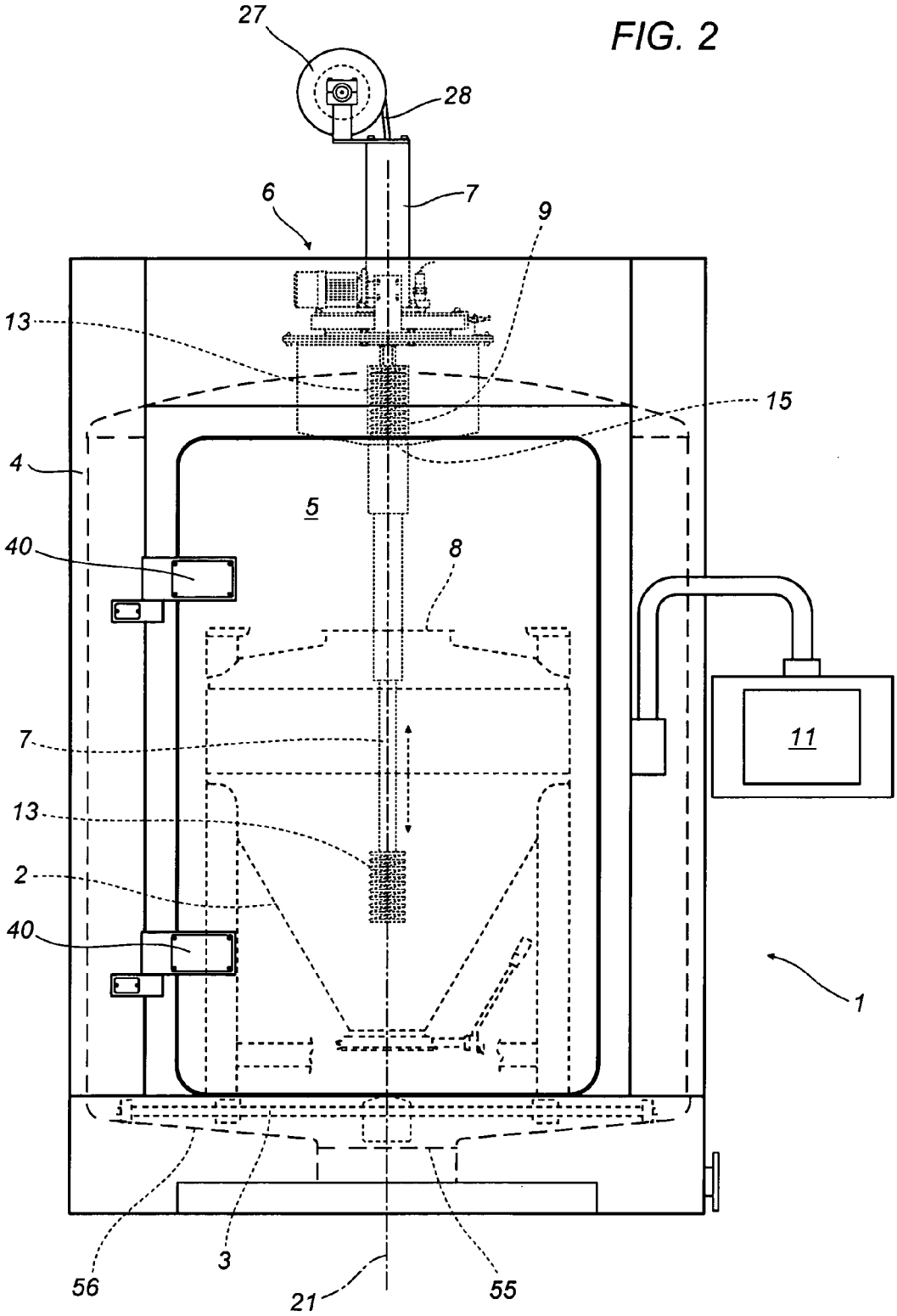
FIG. 2 is a front view of the booth of FIG. 1 and shows the access door through which the container can be placed inside the booth.
Figure 3:
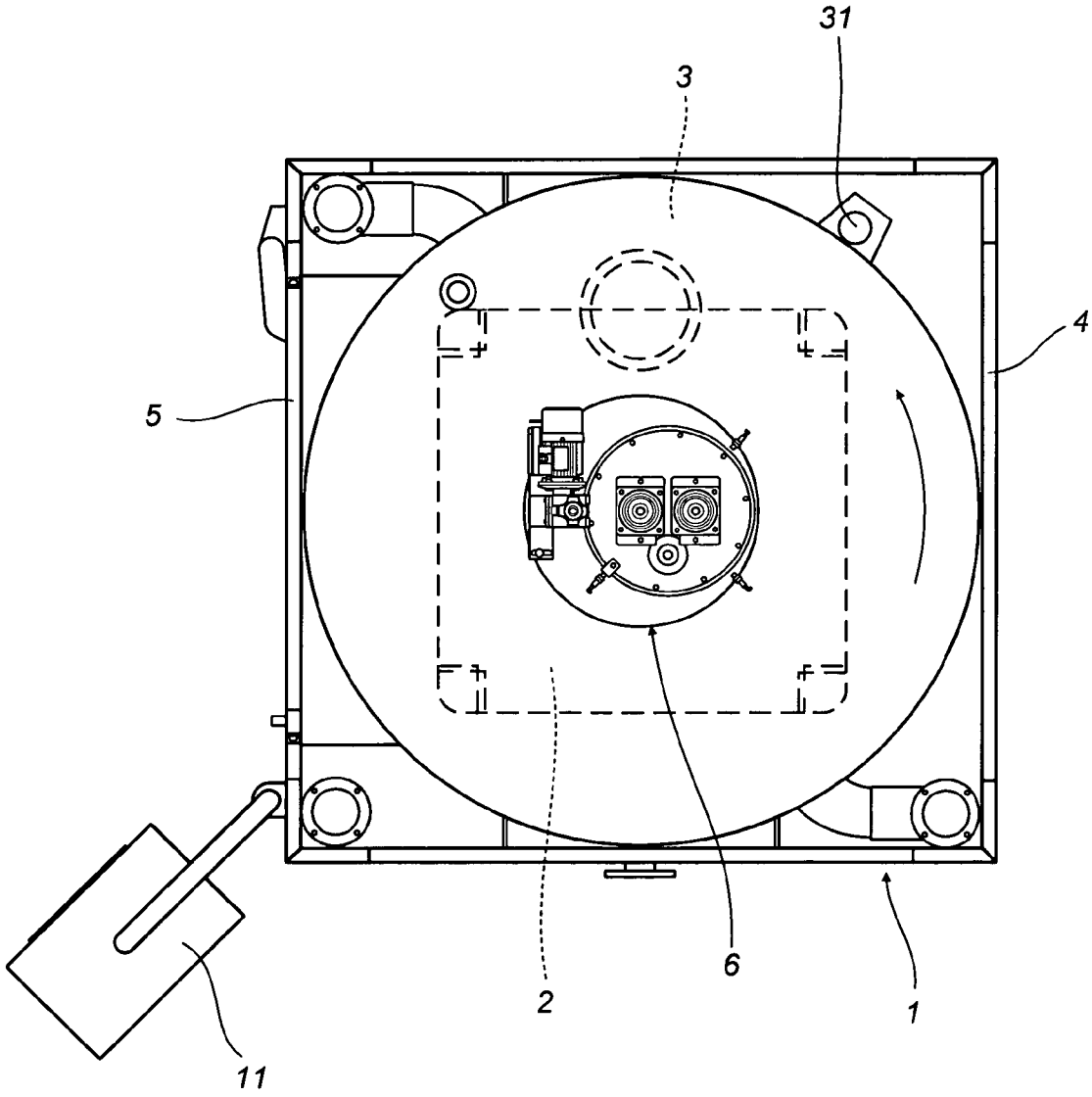
FIG. 3 is a top view of the wash booth of FIG. 1.

Described with reference to the accompanying drawings and, in particular, FIGS. 1 to 3, is a wash booth 1 for containers 2, comprising a container platform 3, preferably of the rotary type, and an outer wall 4 equipped with a door 5 allowing the container to be placed inside.

The platform 3 is rotationally driven about a vertical axis by a motor M2 and a customary transmission unit 58 that is not further described.

The booth also comprises a unit 6, mounted at the top of the booth and communicating with the inside of it, for washing and drying the inside walls of the container 2.

In the preferred embodiment described here, the washing unit 6 is equipped with at least one telescopic cylinder 7 which can be placed at an opening 8 of the container 2 and which can be extended on command in such a way as to position at least one operating head 9 inside the container.

Looking in more detail, the operating head 9 may mount at least one infrared radiant element 13, preferably consisting of a spiral filament, for drying the inside walls of the container 2.

In a preferred embodiment, the unit 6 may comprise one or more telescopic cylinders 7 equipped with operating heads 9 which, depending on requirements, may be fitted with spray nozzles 10 for washing the inside walls of the container, or nozzles (not illustrated) for emitting a flow of hot air (or other suitable gas) for drying the inside walls of the container 2 or radiant elements (not illustrated) for sterilizing the container walls using UV rays.

The booth 1 may also comprise a control panel 11, preferably with a graphical interface, for controlling the booth's washing and drying cycle.

FIG. 3 also schematically shows the possible position of an infrared emitter 31, consisting of a vertical ramp radiating towards the outside walls of the container 2 which is turning on the platform 3, thus drying the outside of the container.

Figure 4:
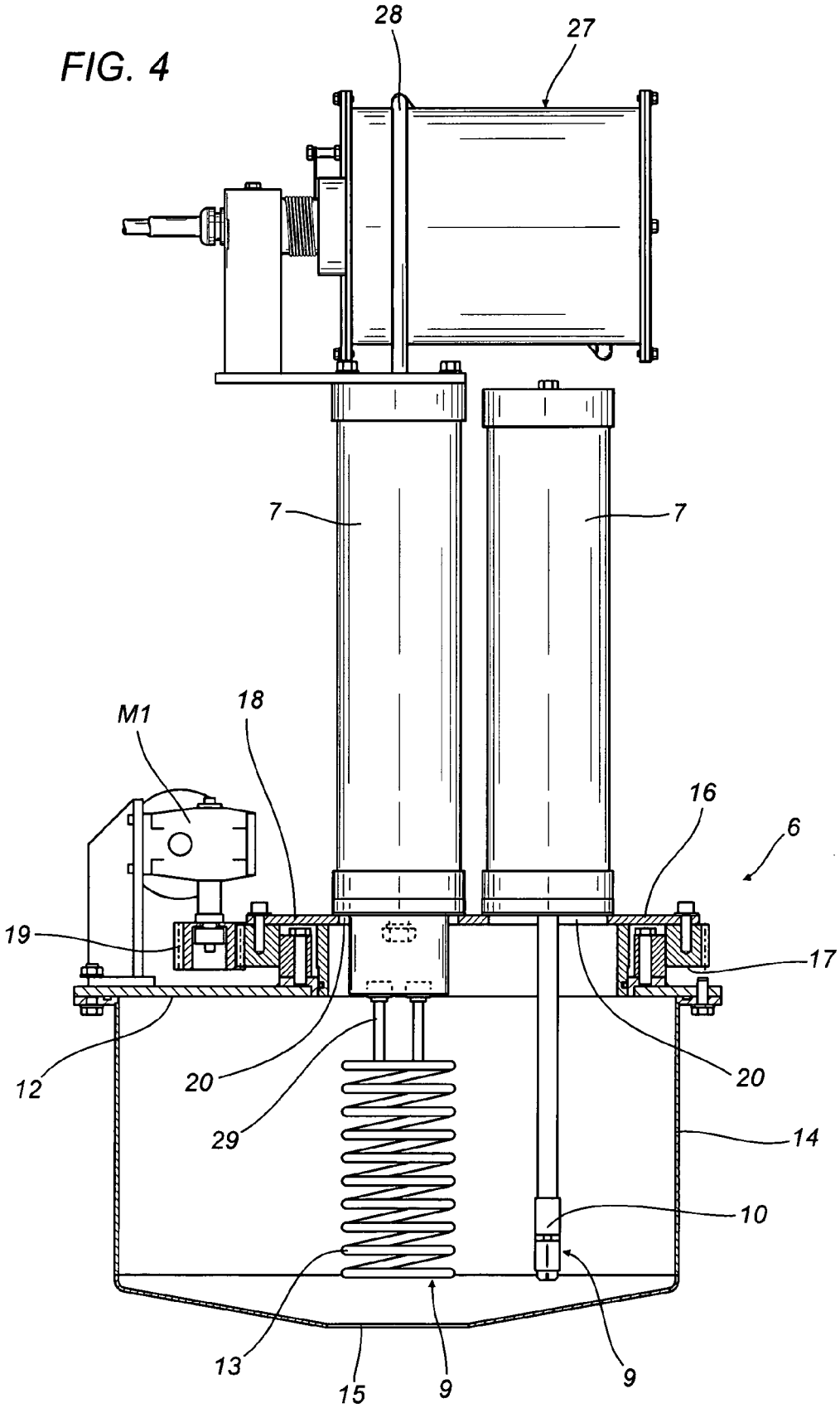
FIG. 4 is a detail view of a washing unit for booths according to the invention.
Figure 5:
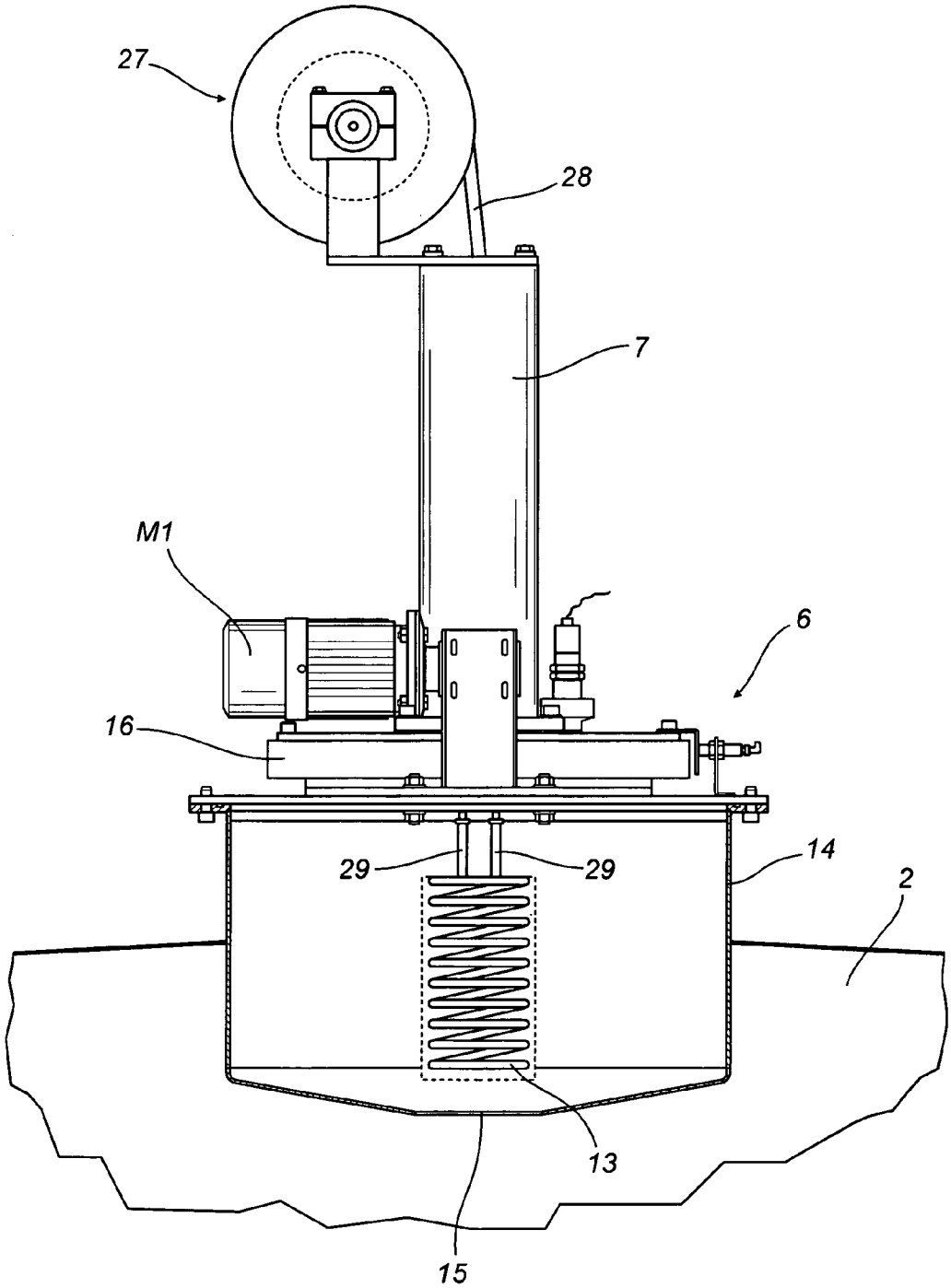
FIG. 5 is a left side view of the unit of FIG. 4.
Figure 6:
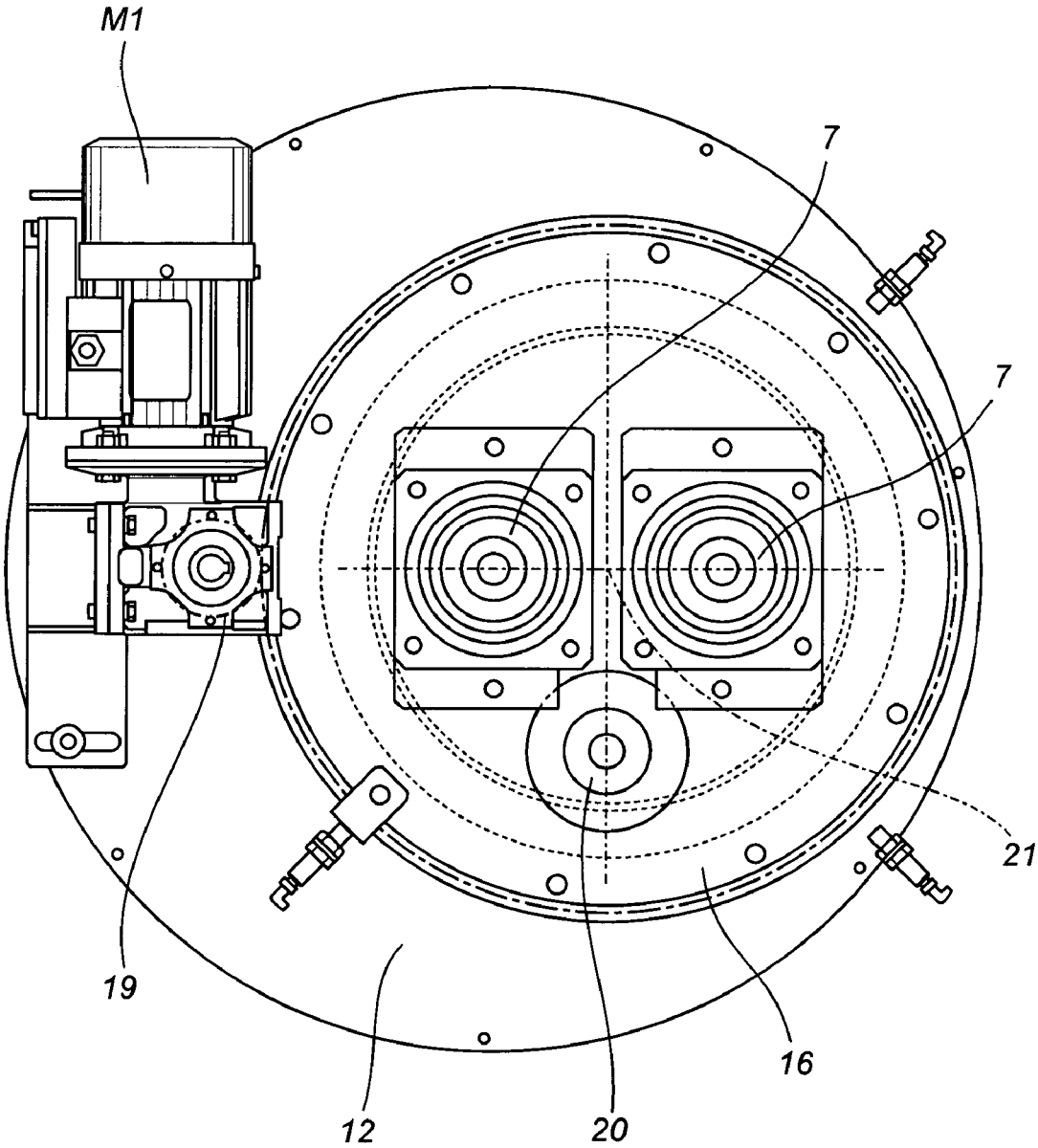
FIG. 6 is a top view of the unit of FIG. 4.

With reference in particular to FIGS. 4 to 6, the unit 6 may comprise a plate 12 shaped like a circular crown fixed at the bottom to the top edge of a tank 14 that is integral with, or may be stably connected to, the booth 1.

The fixed plate 12 rotatably mounts a second plate 16 equipped with a peripheral ring 17 which is internally mounted on the fixed plate 12 by means of rolling bearings 18, and which is externally engaged with a pinion 19 driven on command by a motor M1.

The mobile plate 16 also has one or more holes 20, each used for mounting a cylinder 7 (in the example described, there are two cylinders installed, one for washing and one for drying), which, during operation, may pass through a hole 15 made in the bottom of the tank 14.

According to the invention, the holes 20 for installing the cylinders 7 are made in the rotary plate 16 on a single circle centered on the axis of rotation 21 (shown in FIG. 2) of the plate itself.

The through hole 15 in the tank 14 (and substantially the axis of rotation of the container 2) is located on the same circle so that the rotation of the plate 16 causes the cylinders 7 to be alternately aligned with the hole 15 to access the inside of the container 2.

FIG. 6 shows the position of a third hole 20 for installing a third cylinder 7, for example for placing an operating head with a UV ray emitter inside the container 2 in order to sterilize the container.

The cylinders 7 of the invention are now described in more detail with reference to FIGS. 7 and 7*a* to 7*c*.

Each telescopic cylinder 7 may consist of a succession of telescoping outer sections 22—three in the example illustrated—decreasing in diameter, which together form a telescopic cylinder pneumatically operated by conduits 24 and 25 that deliver a working fluid under pressure in such a way as to extend and retract the sections according to a well-known operating principle.

Inside the sections 22 there are other hollow, telescoping sections 23, mounted in the direction opposite to the outer sections (that is to say, increasing in diameter in the direction in which the sections 22 decrease in diameter) so that, as illustrated in FIG. 7, the outer section 22 with the smallest diameter coincides with the inner section 23 with the largest diameter, which mounts the operating head 9 to be positioned inside the container 2.

When fluid under pressure is applied through the delivery conduit 24, the cylinder 7 is extended until all its sections are out as far as possible (FIG. 7). When the sections have to be retracted (FIG. 7*a*), the working fluid is pumped through the conduit 25 in such a way as to create a vacuum in the outer sections 22. These retract into each other and, thanks to the intermediate protrusions 26, drag the inner sections 23 with them until the cylinder is fully closed, as shown in FIG. 7*a*.

Depending on the type of operating head to be installed, the structure of the cylinder 7 may incorporate different technical devices.

For example, if the cylinder 7 has to mount a washing head 10, the inner sections 23 are reciprocally sealed in such a way that they form a conduit for the passage of the fluid (for example, water) used for washing the container.

Similarly, the inner sections 23 are reciprocally sealed when the operating head is a drying head equipped with nozzles for applying a flow of hot air to the walls of the container.

In the latter case (FIG. 7*c*) the end section 23 might also be equipped with baffles 30 to divert the flow of hot air into the container 2.

In this embodiment, the extension/retraction of the cylinders is performed by a single delivery/suction conduit 48.

Described now, with reference to FIGS. 4 and 5, is the case where the operating head consists of an infrared emitter 13.

In this application, above the cylinder 7, there is a cable reel 27 through which an electrical cable 28 can be fed into the sections 22 of the cylinder 7 and connected to the terminals 29 of the radiant element 13 so that it can be wound/unwound when the cylinder 7 is extended/retracted.

Advantageously, according to the invention, the cylinders 7 of the unit 6 are removable and interchangeable modules so that the unit 6 can be adapted to perform one or more of the aforementioned functions in the container 2 (washing, infrared or air drying, UV sterilization, suction), as well as any other functions that might be required.

Figure 8:
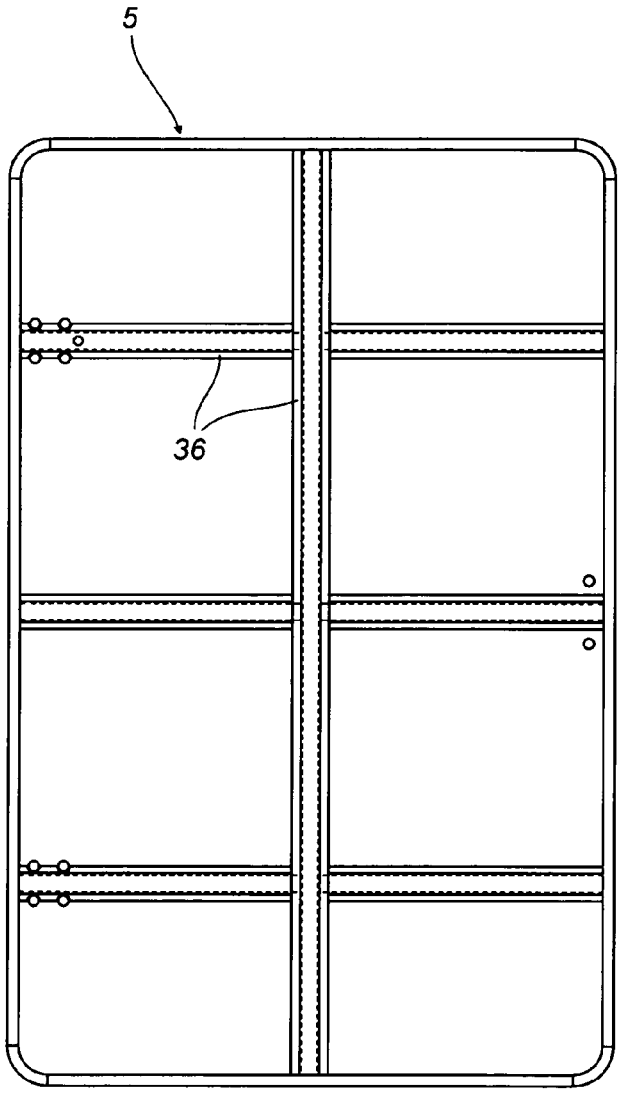
FIG. 8 is a detail view of a door for wash booths according to the invention.
Figure 9:
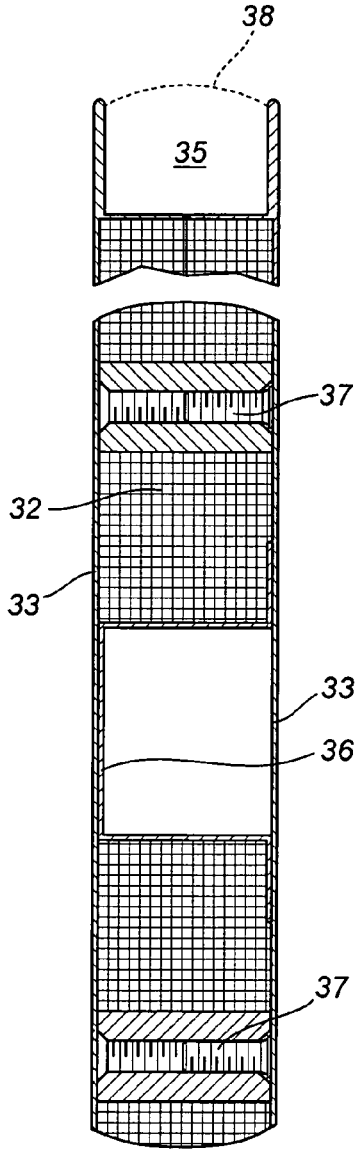
FIG. 9 is a vertical cross section of the door of FIG. 8, showing the internal structure of the door.

A watertight door 5 for wash booths or washing enclosures in general is illustrated in detail in FIGS. 8 and 9.

According to the invention, the door 5 has a "sandwich" structure comprising a middle layer 32, made preferably from a heat insulating material, inserted between two outer sheets 33 which, at the narrow sides of the door, lie within the dimensions of the door 5 and are welded to each other along a center line 34 to form a U-shape recess 35 running all the way around the door.

Preferably, the door 5 also comprises longitudinal and transversal reinforcements 36, consisting of profiles made from substantially omega-shaped bent plate and glued to the inside surfaces of the sheets 33.

Advantageously, the reinforcements 36 and the sheets 33 form a load-bearing structure that guarantees the rigidity of the door 5.

Further, in this solution, at least the outer sheet 33 of the door 5 facing the inside of the booth 1 (the rear surface not in view in FIG. 8) has a smooth, flat and highly washable surface from which liquid residues and dirt can be easily removed.

Figure 10:
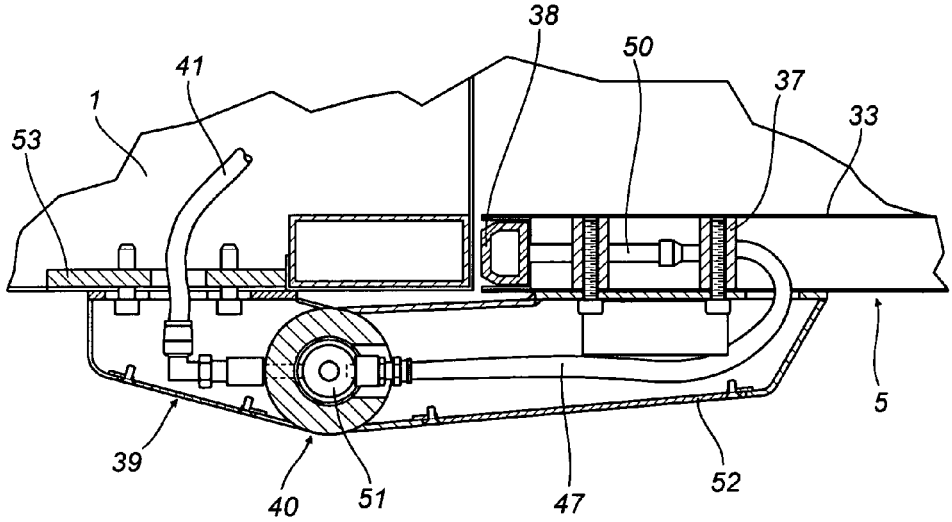
FIG. 10 is a top view in cross section of a hinge for fitting a door to a booth according to the invention.

According to the invention, the recess 35 running around the door 5 accommodates an inflatable seal 38, schematically illustrated by a dashed line in FIG. 9 and shown more clearly in cross section in FIG. 10.

Once inflated, the seal 38 guarantees the watertight seal with the corresponding portions of the booth 1 without necessitating rebates or ledges to accommodate traditional seals.

Further, the use of an inflatable seal permits optimum closure of the booth without creating gaps or recesses where the washing liquid can accumulate.

It is therefore possible to clean the interior of the booth thoroughly (for example using internal sprayers and a suitable system for draining the washing liquid) without requiring the direct intervention of an operator, which advantageously permits rapid re-use of the wash booth and thus making it ideal for series washing of containers fed to the booth continuously.

Figure 11:
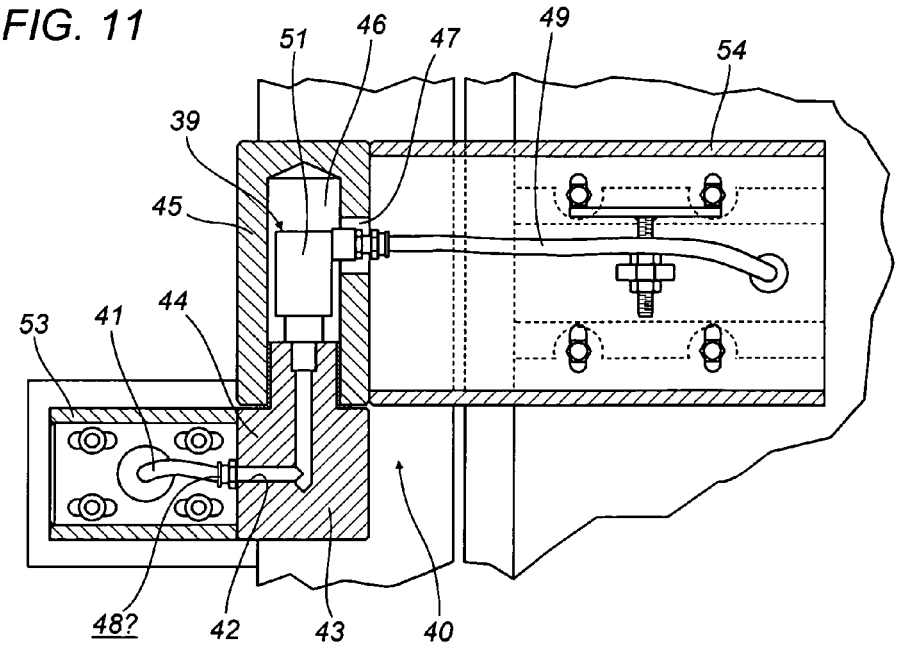
FIG. 11 is a side view in cross section of the hinge of FIG. 10.

According to the invention, and with reference in particular to FIGS. 10 and 11, the inflatable seal 38 may be inflated and deflated by an air circuit 39 made partly inside the body of the hinges 40.

Looking in more detail, the hinges 40 consist of a first element 43 fixed by first plates 53 to the booth 1 and having a hollow pin 44 that communicates with the outside through a transversal hole 42.

The second hinge element 45, fixed to the door 5 by second plates 54, can rotate on the hollow pin 43.

The second hinge element 45 also has a longitudinal cavity 46 to accommodate the pin 43 and a transversal hole 47 that communicates with the cavity 46 and with the outside of the hinge.

The cavity 46 is longer than the pin 44 so that it can accommodate an L-fitting 51 that communicates on one side with the hollow pin 44 and on the other side, through the hole 47, with a first conduit 49 of the air circuit.

The circuit 39 also comprises a second, suction delivery conduit 41 which can be applied from outside the hole 42, and another conduit 50, located inside the door 5 and communicating with the first conduit 49 and with the inflatable seal 38.

With this arrangement, the air from the second conduit 41 can flow in succession through the pin 44, the internal fitting 51 and the conduits 49, 50 to be sent (or sucked) into the seal 38.

The hinge according to the invention further comprises a guard 52 for protecting the conduits of the circuit.

The structure of the booth 1 is advantageously completed by a circuit for draining off the liquid used for washing the container 2 or for cleaning the booth itself after use, the draining point 55 being preferably located at the lowest point of a tapered, concave bottom 56.

FIG. 1 also schematically shows fans 57 for circulating and extracting air and residual steam or vapor.

The invention described has evident industrial applications and may be subject to modifications and variations without thereby departing from the scope of the inventive concept. Moreover, all the details of the invention may be substituted by technically equivalent elements.

What is claimed is:

1. A wash booth for containers comprising:

a rotatable platform for supporting a container;

a wall equipped with a watertight door;

means for washing the inside walls of the container;

a first infrared radiant element for drying at least the inside walls of the container, wherein the first infrared radiant element is supported by an operating head of an extendable telescopic cylinder configured to face the first infrared radiant element to an inside wall of the container; and a second radiant element for infrared drying of the outside walls of the container, said second radiant element consisting of a static vertical ramp having at least one infrared lamp facing the outside wall of the container.

* * * * *